US007325424B1

(12) United States Patent
Wolf, III

(10) Patent No.: US 7,325,424 B1
(45) Date of Patent: Feb. 5, 2008

(54) SADDLE LOCKING DEVICE AND METHOD

(76) Inventor: William B. Wolf, III, 21257 Foxcroft Rd., Middleburg, VA (US) 20117

( * ) Notice: Subject to any disclaimer, the term of this patent is extended or adjusted under 35 U.S.C. 154(b) by 0 days.

(21) Appl. No.: 11/591,356

(22) Filed: Nov. 1, 2006

(51) Int. Cl.
*E05B 73/00* (2006.01)

(52) U.S. Cl. ..... 70/14; 70/18; 70/19; 70/58; 24/166; 24/177; 24/180; 54/44.1

(58) Field of Classification Search ..... 70/14, 70/18, 19, 58, 198–203, 159–162; 54/23, 54/44.1, 46.1; 211/4, 8, 85.11; 24/166, 167, 24/177, 180
See application file for complete search history.

(56) References Cited

U.S. PATENT DOCUMENTS

| | | | | | |
|---|---|---|---|---|---|
| 324,921 | A | * | 8/1885 | Cooper | 24/180 |
| 353,526 | A | * | 11/1886 | Yarger | 190/119 |
| 417,502 | A | * | 12/1889 | Phillips et al. | 294/163 |
| 470,485 | A | * | 3/1892 | Hamilton | 24/166 |
| 679,282 | A | * | 7/1901 | Ling | 54/33 |
| 697,543 | A | * | 4/1902 | Rose | 24/166 |
| 712,291 | A | * | 10/1902 | Gardiner | 24/166 |
| 839,298 | A | * | 12/1906 | Kitterman | 294/146 |
| 1,065,919 | A | * | 7/1913 | Carter | 24/166 |
| 1,085,796 | A | * | 2/1914 | Clark | 24/180 |
| 1,281,213 | A | * | 10/1918 | Russell | 70/65 |
| 1,856,775 | A | * | 5/1932 | Meehan | 24/180 |
| 2,634,480 | A | * | 4/1953 | Ray | 24/180 |
| 2,710,732 | A | * | 6/1955 | Peters | 248/100 |
| 3,205,637 | A | * | 9/1965 | Welton | 54/46.1 |
| 3,817,064 | A | * | 6/1974 | Sallee | 70/58 |
| 4,155,458 | A | * | 5/1979 | Moline | 211/4 |
| 4,413,465 | A | * | 11/1983 | Blevins et al. | 54/46.1 |
| 4,683,729 | A | * | 8/1987 | Rogers | 70/58 |
| 4,685,314 | A | * | 8/1987 | Greenwalt et al. | 70/57 |
| 4,823,568 | A | * | 4/1989 | Rogers et al. | 70/58 |
| 4,864,834 | A | * | 9/1989 | Waite | 70/14 |
| 5,036,685 | A | * | 8/1991 | Napolitano | 70/161 |
| 5,732,575 | A | * | 3/1998 | Kaveney | 70/2 |
| 5,949,339 | A | * | 9/1999 | Ettinger et al. | 340/573.1 |
| 6,018,968 | A | * | 2/2000 | Sides | 70/14 |

* cited by examiner

*Primary Examiner*—Lloyd A. Gall
(74) *Attorney, Agent, or Firm*—Nash & Titus, LLC; Caroline M. Nash

(57) ABSTRACT

A saddle locking device for preventing unauthorized use of a saddle is the subject of the invention. The device has a lower plate with billet pins protruding there from. The device also has an upper plate defining openings for receiving the billet pins. There is a locking mechanism for securely locking the lower plate to the upper plate so that the billet pins are locked through the openings defined by the upper plate. In use, the device is attached to the billets of a saddle where the billet pins are threaded through the holes in the billets and the device is then closed and locked. Optionally, the device has a locking mechanism such as a cable to connect the device to a fixture.

16 Claims, 4 Drawing Sheets

SADDLE LOCKING DEVICE AND METHOD

BACKGROUND OF THE INVENTION

1. Field of the Invention

The present invention relates to the field of saddle security. More specifically, the invention relates to a locking device for attaching to the billets of a saddle to prevent unauthorized use of a saddle and/or to prevent saddle theft.

2. Brief Description of Related Art

An equine saddle is typically a large investment. A saddle is also a very personal piece of equipment to an equine enthusiast. It is purchased to fit the rider and the horse with a great degree of care. Saddles are typically stored in tack rooms of private or public boarding facilities. Saddles are also stored in horse trailers in instances where the horse that it is used with is being transported to a horse show or other equine event. They are fairly light weight and easy to carry. There remains a need to secure these expensive and important pieces of equipment from being stolen.

There is also the problem of unauthorized use. For example, in a common tack room in a boarding facility, there may be a problem of a person other than the owner using a saddle that does not belong to him or her without permission. The owner of the saddle wishes to prevent unauthorized use in the owner's absence but still wishes to store the saddle at the boarding facility. There remains a need to secure the saddle so that it is unusable to others without permission.

Briefly, these objects and other objects of the present invention as hereinafter will become more readily apparent can be attained by providing a saddle locking device that assists in attaching a saddle to a permanent fixture or other object and connects to the billets of a saddle to make it unsuitable for use.

SUMMARY OF THE INVENTION

The saddle locking device for preventing unauthorized use or theft of a saddle has a lower plate. The lower plate has a first half of a hinge on a first side and a base-piece on an opposite second side. The lower plate further has one or more billet pins protruding upwards from an upper planar surface of the lower plate for threading through billet holes on billets of a saddle. The saddle locking device also has an upper plate. The upper plate has a second half of a hinge on a first side that is complementary in shape and placement for receiving and locking with the first half of the hinge from the lower plate and providing a means for opening and closing the upper plate against the lower plate. The upper plate further has a head piece on an opposite second side from the hinge. The upper plate defines one or more holes or openings for receiving the billet pins from the lower plate. In operation, the upper plate closes over the lower plate, pivoting from the hinge and the upper plate receives the billet pins through the holes therein. The head piece and the base piece orient in the closed position for receiving a locking device or mechanism that secures the upper plate to the lower plate.

DETAILED DESCRIPTION

Figure 1:
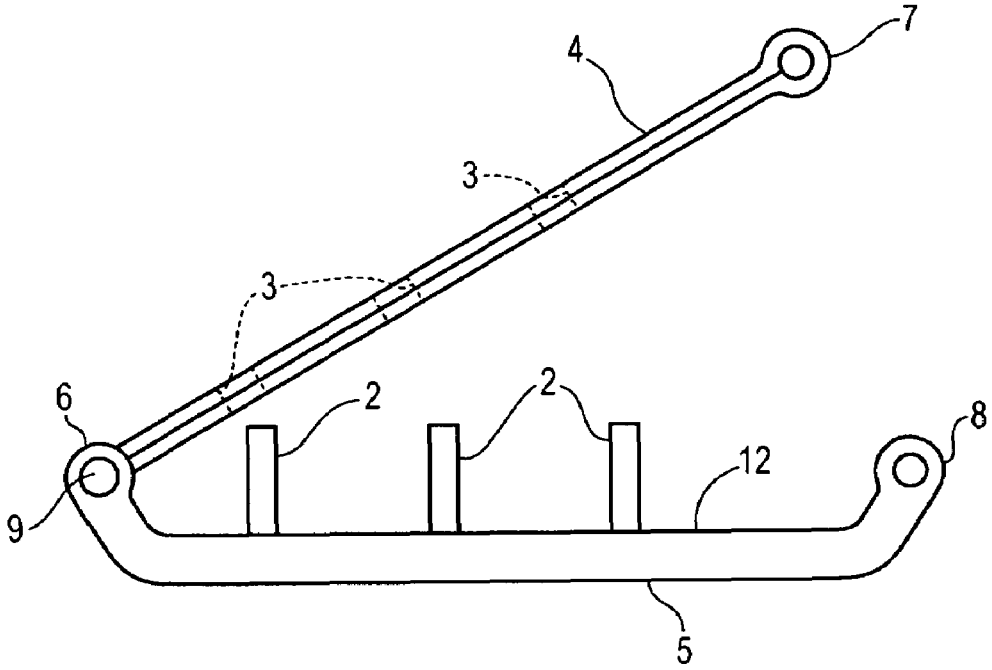
FIG. 1 is a side view of the saddle locking device in the open position.

In reference to the figures, the present invention is directed to a saddle locking device 1. The device has a lower plate 5 that is substantially flat with an upper facing surface 12. One or more billet pins 2 protrude upwards from the upper facing surface 12. In the case of multiple billet pins, the billet pins are placed in a line or row. The billet pins are intended to be threaded through the holes in saddle billets 24. The device also has an upper plate 4 that is substantially flat. The upper plate defines openings 3 for receiving the billet pins 2 of the lower plate 5. The number of openings in the upper plate corresponds to the number of billet pins and the openings are spaced to receive the billet pins. The upper and lower plates are between 4 and 16 inches wide and 4 and 16 inches tall. Width is defined as the length of the device that is parallel with the row of billet pins if multiple billet pins are present. The upper and lower plates may vary in size or shape depending on the type of saddle. The upper plate may be solid or laminated as shown in FIG. 1.

The locking device has a locking mechanism 10 for securely locking the lower plate to the upper plate with the billet pins fitting through the openings defined by the upper plate. In operation, the billet pins fit through holes in billets of a saddle and then through the upper plate holes or openings to sandwich the billets between the upper and lower plates. The locking mechanism is engaged which prevents the billet pins from being removed from the billets by holding the upper plate to the lower plate.

Figure 5:
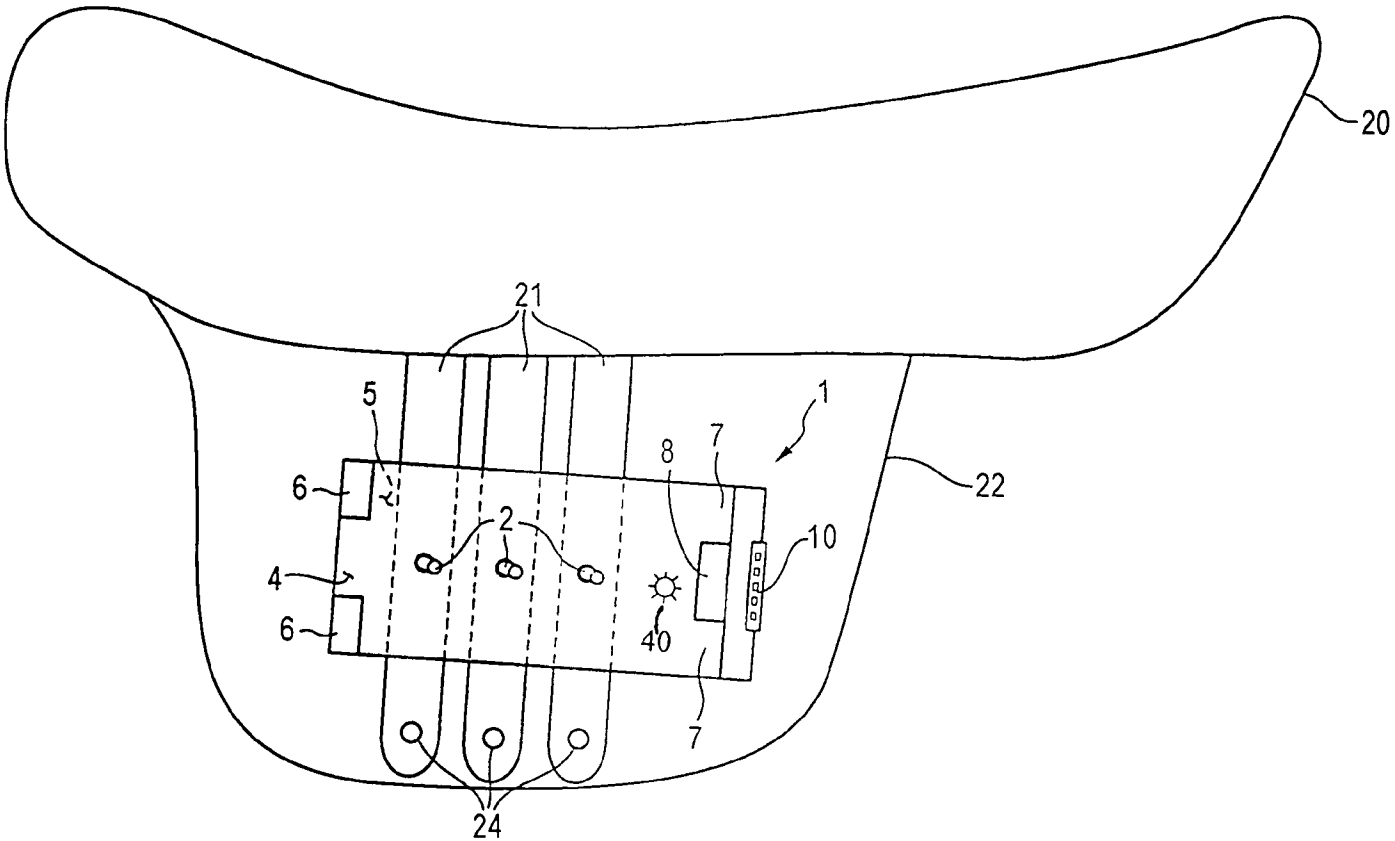
FIG. 5 is a perspective view of the saddle locking device attached to the billets of a saddle.

In FIG. 5, a saddle 20 is shown with saddle billets 21, saddle flap 22, and saddle seat. The locking mechanism 10 is separate from the lower and upper plate. However, the locking mechanism may be integral with either plate. It may be a padlock, combination lock or cable lock fitted through a head piece 7 of the upper plate and a base piece 8 of the lower plate 5 to hold the plates together.

Figure 6:
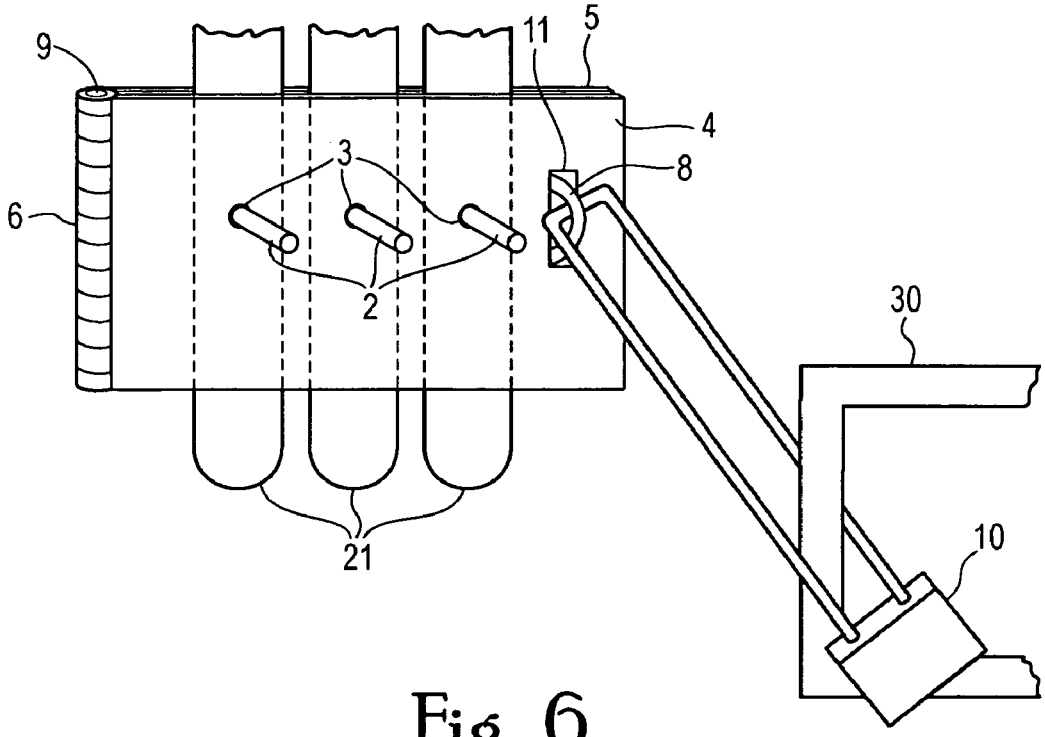
FIG. 6 is a perspective view of the saddle locking device showing another embodiment of a locking device.
Figure 7:
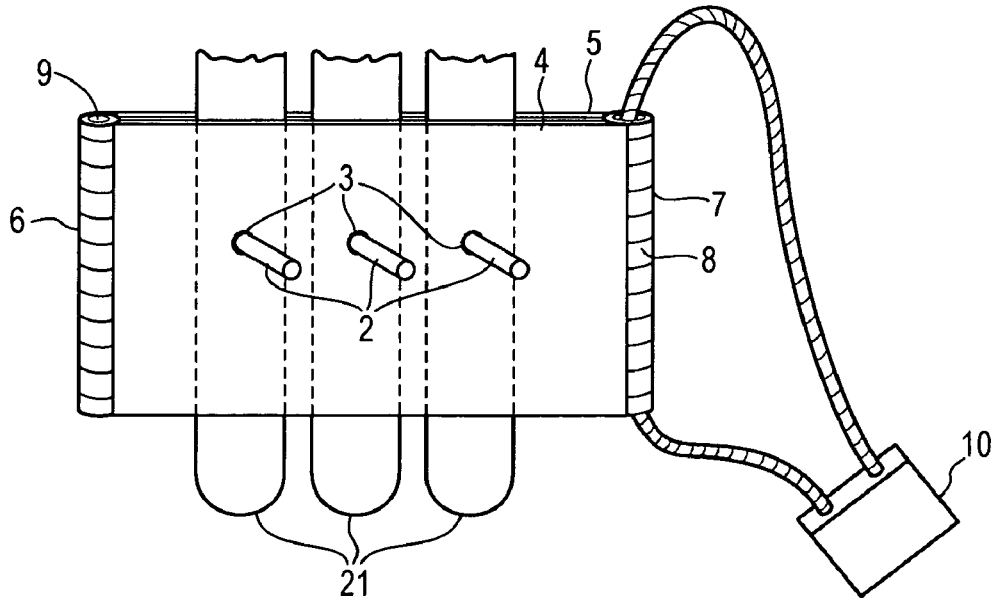
FIG. 7 is a perspective view of the saddle locking device showing another embodiment of a locking device.

Other locking mechanisms are also contemplated with the proviso that the locking mechanism chosen secures the upper plate to the lower plate so that saddle billets cannot be removed from the billet pins in the locked position. An example of a different locking mechanism is shown in FIG. 6, wherein a locking device 10, such as an elongated padlock, is threaded through the base piece 8 after the base piece has been threaded through a slit 11 defined by said upper plate 4, the saddle billets 21 are secured by the billet pins 2. The locking device is secured to a fixture 30.

When the saddle locking device is in place, the billet pins point outwards away from the saddle making it impossible for an unauthorized user to comfortably sit on the saddle.

Further, when the saddle locking device is in place, it can be connected to a permanent fixture or other object by either the locking mechanism itself or another means such as a cable with sufficient length for connection. This prevents theft of an intact saddle.

The billet pins are of a length of between ½-10 inches and preferably ½ inches. The billet pins are aligned in a row and are typically 1-3 inches apart and preferably 1 3/16 inches apart. The diameters of the billet pins are complementary to diameters of the openings defined by the upper plate and the billet holes 24 in standard billets. A lateral cross-section of a billet pin is essentially round. There are 1-3 billet pins and preferably 3 billet pins to correspond to a typical English saddle that typically has three hanging leather billets.

The upper plate and lower plate are preferably connected together by a hinge 6 at one end of each plate. The locking mechanism is preferably located at the other end of each plate. The hinge permits the upper plate to be pivoted upward or downward from the lower plate and still remain connected to the lower plate. The upper and lower plates are rectangular, oblong or square in shape, however other shapes such as kidney, round, c-shape, etc. are also contemplated. The upper and lower plates may be shaped at the ends thereof so that when the device is in the locked position, the upper and lower plates can accommodate the thickness of the billets between the plates, as shown in FIG. 2.

Figure 2:
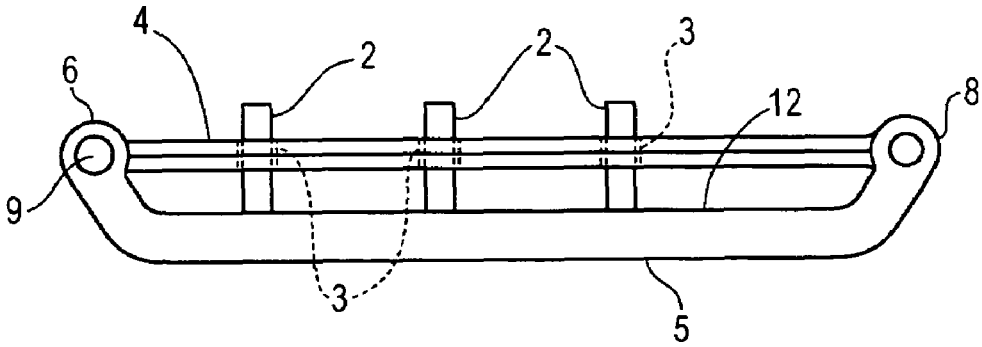
FIG. 2 is a side view of the saddle locking device in the closed position.
Figure 3:
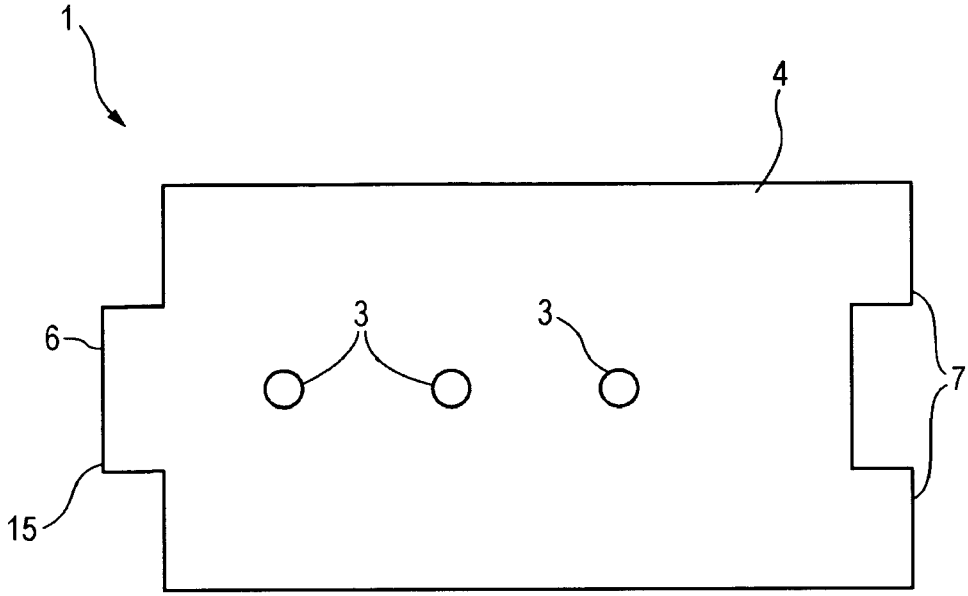
FIG. 3 is an overhead view of the upper plate of the saddle locking device.
Figure 4:
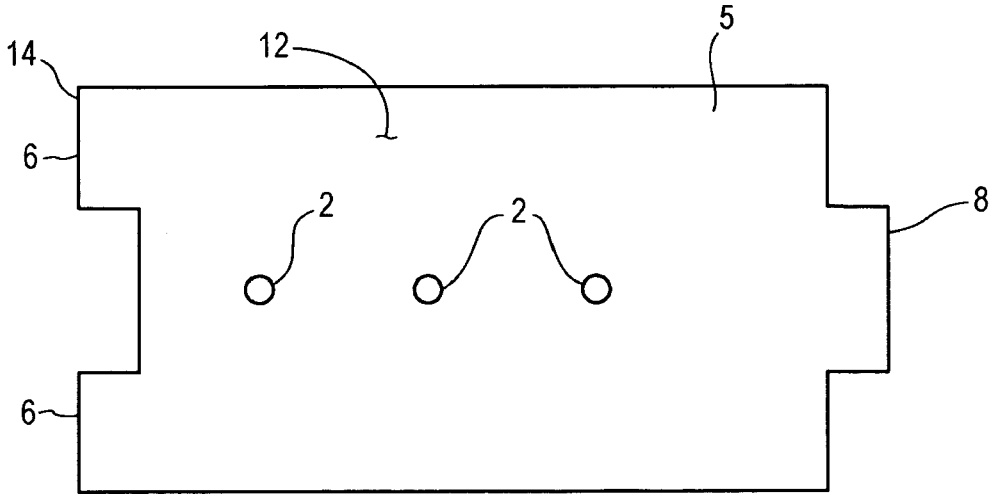
FIG. 4 is an overhead view of the lower plate of the saddle locking device.

FIG. 2 shows the upper plate being substantially flat while the lower plate curves upward at its ends. In the alternative, the lower plate could be substantially flat with the upper plate curving downward at its ends to create a space between the plates for accommodating the thickness of saddle billets.

The material used for manufacturing the plates and billet pins must have sufficient strength to prevent unauthorized use or theft. Suitable materials include metal composites, alloys or hard polymer material and plastics. Decorative materials such as brass or chrome may also be used. Decorative indicia 40 can also be incorporated onto or into the saddle locking device such as name plaques, engravings, and the like, see FIG. 5.

Having generally described this invention, a further understanding can be obtained by reference to certain specific examples which are provided herein for purposes of illustration only and are not intended to be limiting unless otherwise specified.

EXAMPLES

Example 1

An example of a preferred saddle locking device for preventing unauthorized use or theft of a saddle has a lower plate, wherein the lower plate 5 has a first half of a hinge 14 on a first side and a base-piece 8 on an opposite second side. The lower plate 5 further has three billet pins 2 protruding upwards from the lower plate 5 for threading through billet holes 3 on billets of a saddle. The upper plate 4 has a second half of a hinge 15 on a first side that is complementary in shape and placement for receiving and locking with the first half of the hinge 14 from the lower plate 5 and providing a pivot point hinge 6 for opening and closing the upper plate 4 against the lower plate 5. The upper plate 4 further has a head piece 7 on an opposite second side from the hinge 6, the upper plate further defining one or more holes 3 for receiving the billet pins 2 from the lower plate 5. In operation, the upper plate 4 closes over the lower plate 5, pivoting from the hinge 6 and the upper plate 4 receives the billet pins 2 through the holes 3 and the head piece 7 and the base piece 8 orient for receiving a locking device 10 that secures the upper plate 4 to the lower plate 5. In this example, each of the head piece and base piece is cylindrical in shape so that when the device is closed, the cylindrical shaped base piece and head piece receive a locking device threaded there through. Also, in this example, the first half of a hinge 14 and the second half of a hinge 15 are cylindrical in shape for receiving a hinge pin 9 for completing a working standard hinge 6.

Example 2

The invention is also directed to a method for preventing unauthorized use or theft of a saddle with the device described herein. The saddle to be protected has billets that define holes. In practice, a user inserts the billet pins of the lower plate through the holes defined by the billets. Then the user closes the upper plate over the lower plate so that the billet pins protrude through the openings defined by the upper plate. Then the user securely locks the lower plate to the upper plate with the locking mechanism so that the billet pins are locked in place through the billets and the openings defined by the upper plate to prevent unauthorized use or theft of the saddle.

The user may optionally secure the saddle locking device to a permanent fixture or other object by attaching it thereto with a cable connected to the locking device, with the locking mechanism itself if the locking mechanism is a large padlock or cable locking device.

Having now fully described the invention, it will be apparent to one of ordinary skill in the art that many changes and modifications can be made thereto without departing from the spirit or scope of the invention as set forth herein.

What is claimed is:

1. A saddle assembly comprising:

a saddle having laterally adjacent billets attached thereto for securing said saddle to a girth, said billets comprising elongated straps defining billet holes; and a saddle locking device, said saddle locking device comprising: a lower plate, said lower plate comprising billet pins protruding there from; an upper plate defining openings for receiving said billet pins; and a locking mechanism for securely locking said lower plate to said upper plate so that in use said billet pins are locked through said billet holes and then though said openings defined by said upper plate, and said locking mechanism is secured to prevent unauthorized use or theft of a saddle.

2. The saddle locking device of claim 1, wherein said billet pins are a length between 0.5 and 10 inches.

3. The saddle locking device of claim 1, wherein said billet pins are placed in a line and spaced equal distance apart, said distance being 1-2 inches for receiving an individual billet for each billet pin, wherein each billet pin is threaded through said billet holes.

4. The saddle locking device of claim 1, wherein said locking mechanism is separate from said lower and upper plate and comprises a padlock, combination lock or cable lock.

5. The saddle locking device of claim 1, wherein said upper plate and said lower plate are connected together by a hinge.

6. The saddle locking device of claim 1, wherein said upper and lower plate are rectangular, oblong or square in shape.

7. The saddle locking device of claim 1, wherein the diameters of said billet pins are complementary to diameters of said openings defined by said upper plate and said billet holes.

8. The saddle locking device of claim 1, wherein a lateral cross-section of said billet pins is essentially round in shape.

9. The saddle locking device of claim 1, wherein said locking mechanism is integral with at least one of the plates.

10. The saddle locking device of claim 1, wherein said upper and lower plates are between 4 and 16 inches wide and 4 and 16 inches tall.

11. The saddle locking device of claim 1, wherein said upper plate, and lower plate and pins comprise metal or hard polymer material.

12. The saddle locking device of claim 1, further including decorative indicia on a plate.

13. The saddle locking device of claim 1, wherein said device is rectangular, oblong, square, kidney, round, or c-shape.

14. A method for preventing unauthorized use or theft of a saddle with said saddle assembly of claim 1 comprising:

a. inserting said billet pins of said lower plate through said billet holes;

b. closing said upper plate over said lower plate so that said billet pins protrude through said openings defined by said upper plate; and c. securely locking said lower plate to said upper plate with said locking mechanism so that said billet pins are locked in place through said billets and said openings defined by said upper plate to prevent unauthorized use or theft of said saddle.

15. A saddle locking assembly comprising:

a saddle having laterally adjacent billets attached thereto for securing said saddle to a girth, said billets comprising elongated straps defining billet holes; and a locking device for preventing unauthorized use or theft of said saddle, said locking device comprising:

a. a lower plate, said lower plate comprising a first half of a hinge on a first side and a base-piece on an opposite second side, said lower plate further comprising one or more billet pins protruding upwards from said lower plate for threading through said billet holes;

b. an upper plate, said upper plate comprising a second half of a hinge on a first side that is complementary in shape and placement for receiving and locking with said first half of said hinge from said lower plate and providing a pivot point for opening and closing said upper plate against said lower plate, said upper plate further comprising a head piece on an opposite second side from said hinge, said upper plate further defining one or more receiving holes for receiving said billet pins from said lower plate;

c. wherein, in operation, said upper plate closes over said lower plate, pivoting from said hinge and said billet pins are inserted though said billet holes and then said upper plate receives said billet pins through said receiving holes, and said head piece and said base-piece orient for receiving a locking device that secures said upper plate to said lower plate to prevent unauthorized use or theft of said saddle.

16. A method for preventing unauthorized use or theft of a saddle having laterally adjacent billets with a saddle locking device comprising:

a) providing a saddle locking device comprising:

a lower plate, said lower plate comprising billet pins protruding therefrom;

an upper plate defining openings for receiving said billet pins; and a locking mechanism for securely locking said lower plate to said upper plate so that said billet pins are locked through said openings defined by said upper plate; and b) inserting said billet pins of said lower plate through billet holes defined by said billets;

closing said upper plate over said lower plate and said billets so that said billet pins protrude through said openings defined by said upper plate; and securely locking said lower plate to said upper plate with said locking mechanism so that said billet pins are locked in place through said billets and said openings defined by said upper plate to prevent unauthorized use or theft of said saddle.

* * * * *